US005281781A

United States Patent [19]

Herchenröther et al.

[11] Patent Number: 5,281,781

[45] Date of Patent: Jan. 25, 1994

[54] APPARATUS FOR SWITCHING A HIGH-CURRENT POWER SOURCE

[75] Inventors: Karl Herchenröther, Birstein; Michael Protzmann, Wächtersbach; Heiko W. Spengemann, Langenselbold, all of Fed. Rep. of Germany

[73] Assignee: Leybold Durferrit GmbH, Cologne, Fed. Rep. of Germany

[21] Appl. No.: 768,011

[22] Filed: Sep. 30, 1991

[30] Foreign Application Priority Data

Jul. 17, 1991 [DE] Fed. Rep. of Germany ..... 4123673

[51] Int. Cl.[5] ..... H01H 35/38; H01H 1/50

[52] U.S. Cl. ..... 200/82 R; 200/82 B

[58] Field of Search ..... 200/151, 82 R, 82 B, 200/148 R, 148 A, 150 R, 150 G

[56] References Cited

U.S. PATENT DOCUMENTS

| | | | |
|---|---|---|---|
| 2,228,814 | 1/1941 | Curtis | 200/248 |
| 3,153,131 | 10/1964 | Gratzmuller | 200/251 |
| 3,987,262 | 10/1976 | Rostron | 200/148 A |
| 4,389,554 | 6/1983 | Freeman | 200/148 A |
| 4,489,226 | 12/1984 | Holmgren et al. | 200/148 A |
| 4,511,776 | 4/1985 | Romier et al. | 200/148 A |
| 5,059,932 | 10/1991 | Bonhomme | 200/148 R X |

FOREIGN PATENT DOCUMENTS

| | | |
|---|---|---|
| 1293360 | 4/1969 | Fed. Rep. of Germany . |
| 2001534 | 11/1970 | Fed. Rep. of Germany . |
| 2705913 | 8/1978 | Fed. Rep. of Germany . |
| 2707589 | 8/1978 | Fed. Rep. of Germany . |
| 3130465 | 2/1983 | Fed. Rep. of Germany . |
| 3312436 | 5/1984 | Fed. Rep. of Germany . |
| 562013 | 7/1977 | U.S.S.R. . |
| 838788 | 6/1981 | U.S.S.R. . |

*Primary Examiner*—J. R. Scott

*Attorney, Agent, or Firm*—Felfe & Lynch

[57] ABSTRACT

Apparatus for switching a high-current power supply, for example for transportable melting systems in melting and remelting plants, with a stationary apparatus part and a movable apparatus part, a contact surface between the stationary and the movable part as well as a device for locking the two parts, the contact surface (2*d*) on the stationary part (S) being preferably in the form of a hemisphere (2*a*) and the corresponding contact surface (3*d*) on the movable part (M) being preferably configured as a conical inside surface (3*a*) and the contacts being joinable forcibly with one another by means of a clamping device, the clamping device consisting for example of a centering and drawing bolt (2*b*) and of a corresponding ball clamping device, and that the clamping device is electrically insulated by means of insulators (7, 12) from the current-carrying contacts.

4 Claims, 3 Drawing Sheets

APPARATUS FOR SWITCHING A HIGH-CURRENT POWER SOURCE

The invention relates to an apparatus for switching, especially opening and closing, a high-current power supply, for example for transportable melting devices in fusing and remelting apparatus, with a stationary apparatus unit and a line coming preferably from a stationary high-current generator, and a mobile apparatus unit with a high-current power feeder, preferably leading to a load, a contact surface between the stationary and the mobile units for the transfer of the high current, as well as an apparatus for shutting down both units.

Devices are also known for similar applications, as for example (German Pat. 12 93 360) which describes a device for holding, and supplying current to, a consumable electrode in an arc furnace, especially in a vacuum arc furnace, with an electrode holding rod whose bottom end is configured as a holding head, and with holding means disposed on the holding head, which engage recesses on the electrode head.

These known embodiments of apparatus for switching a high-current feed have the disadvantage that they can no longer be used reliably and safely in the transmission of a current of, for example, 30 to 60 thousand amperes, since the maximum current loading of interlockingly joined high-current contacts is technically limited. In addition there are the adverse external conditions of application of, e.g., metallurgical apparatus in extremely dusty environments, which by contamination additionally interfere with the trouble-free transfer of the high current to the contact surfaces.

The invention is therefore addressed to the problem of developing an apparatus for switching a high-current power supply, which will permit a reliable transfer of high currents—greater than 30 kA—and will eliminate the effect of a dusty environment on the transfer of high current.

This problem is solved according to the invention in that the contact surface on the stationary part is preferably in the form of a hemisphere and the corresponding contact surface on the mobile part is preferably configured as a spherical inside surface and the contacts can be joined positively to one another by a clamping means, the clamping means consisting, for example, of a centering and drawing bolt which is affixed to the stationary part, as well as a corresponding ball clamping device which is part of a mobile part, and that the clamping means is insulated electrically from the current-carrying contacts by means of insulators.

The apparatus advantageously has a ball connection/cone connection, which first has an optimum contact surface with a self-centering ability, and in combination with a clamping means, such as a ball clamping means, achieves a positive joining of the two contacts. In order to achieve a separate course of lines of force and of current within the apparatus, the current-carrying area is separated structurally and by the insertion of electrical insulators from the area subject to force.

The contaminating influence of the extremely dusty ambient air on the two contact surfaces has been virtually eliminated by means of a cover and by means of a device for cleaning the contact surfaces with, for example, compressed air.

Additional possibilities of embodiment and features are further described and identified in the subordinate claims.

Referring to the drawings, the drawings show an apparatus in accordance with the invention for switching a high-current power supply in different states of operation.

Referring now to the drawings.

Figure 1:
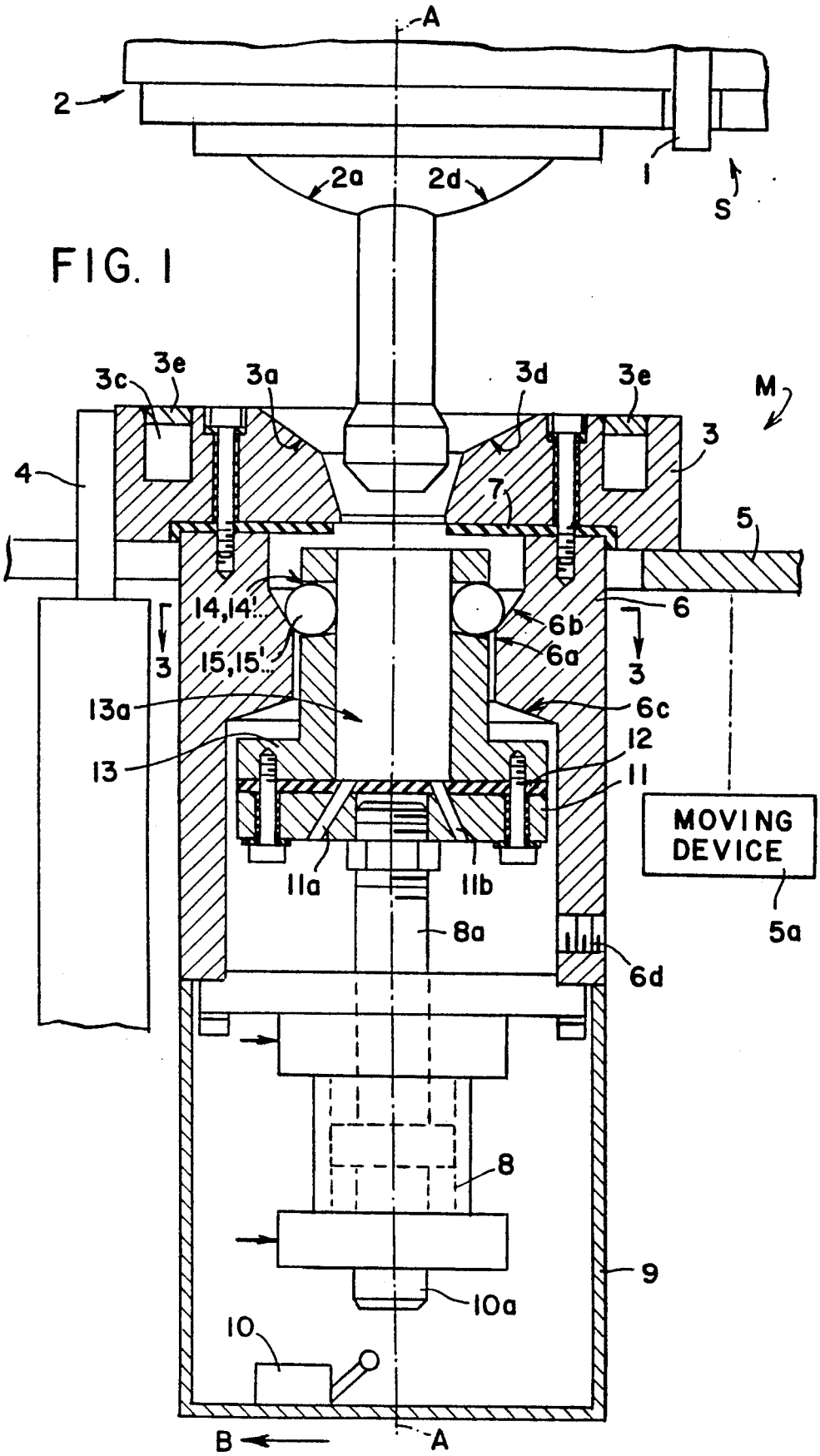
FIG. 1 is a sectional view of the apparatus in the open state of the high-current power supply.
Figure 2:
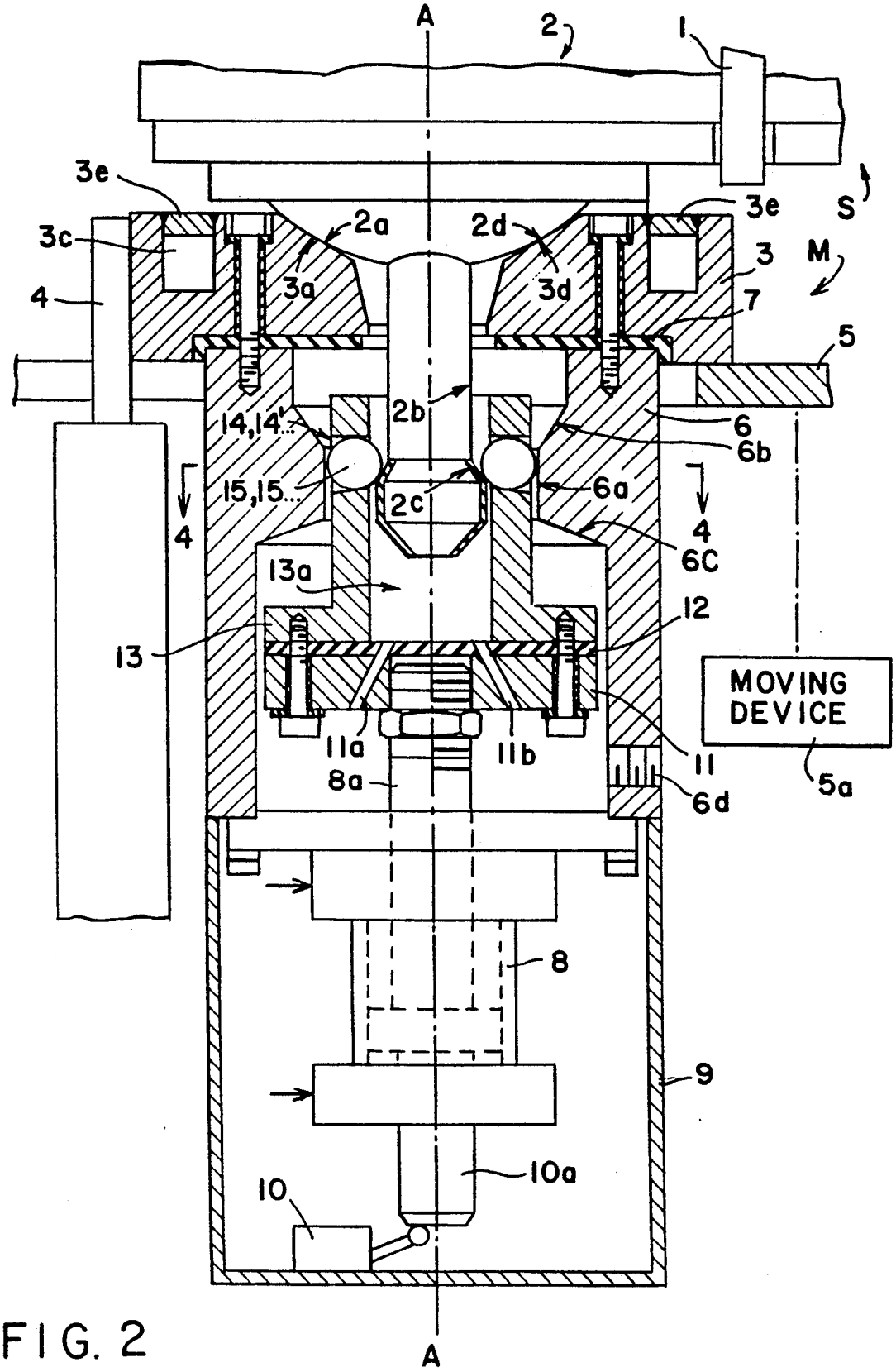
FIG. 2 is a sectional view of the apparatus in the closed state of the high-current power supply.
Figure 3:
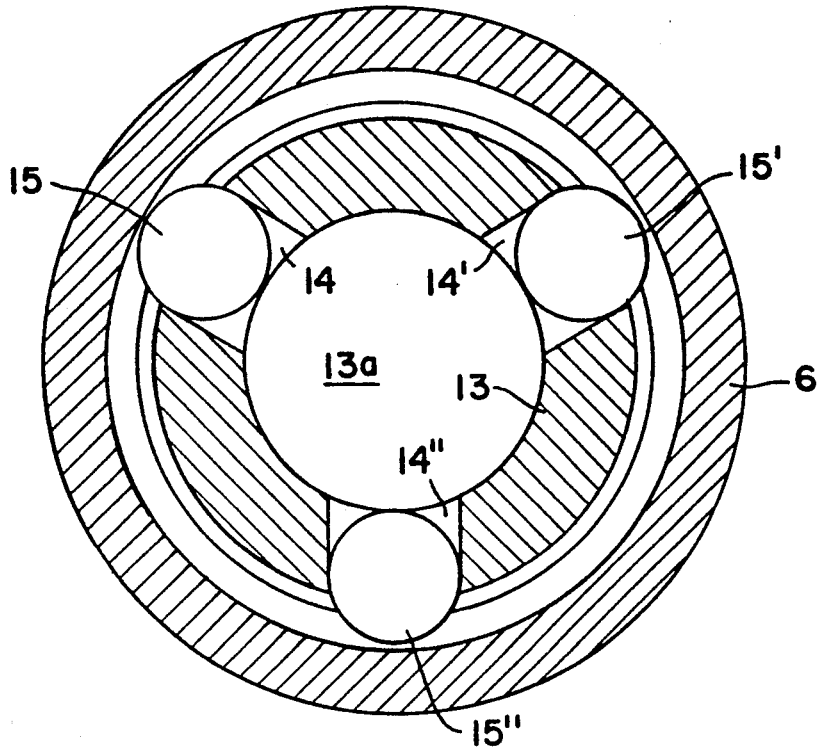
FIG. 3 is a sectional view of the apparatus taken along line 3—3 of FIG. 1.
Figure 4:
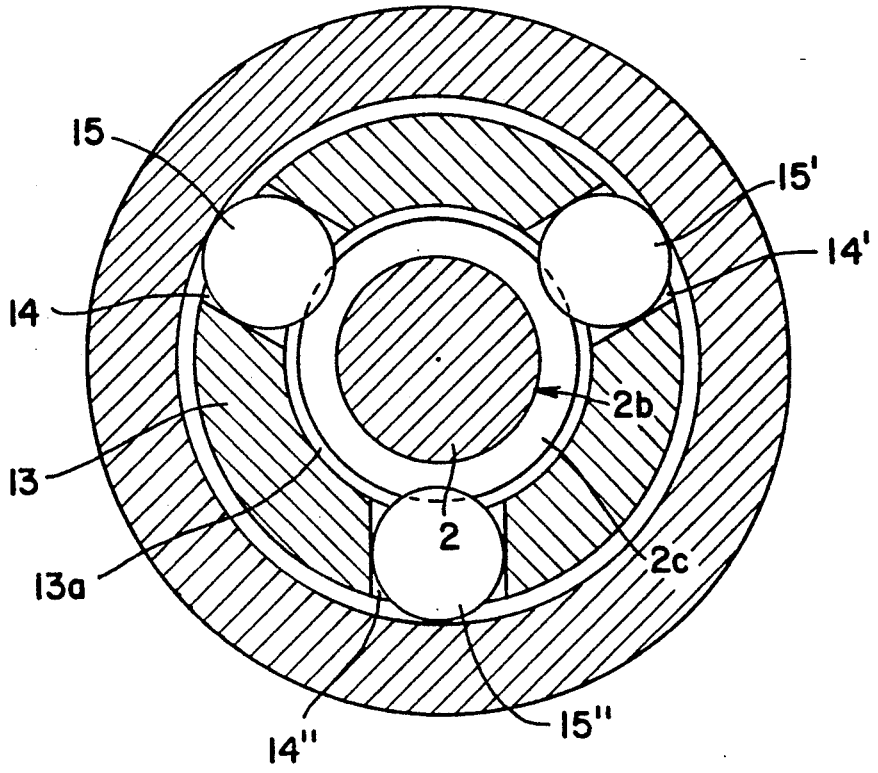
FIG. 4 is a sectional view of the apparatus taken along line 4—4 of FIG. 2.

A bus bar 1 runs from a stationary high-current source, such as a transformer, for example, to a contact piece 2. This contact piece 2 forms the stationary part 5 of the high-current power supply and is stationary. It is substantially rotationally symmetrical with the axis A—A and at its bottom end it is in the shape of a hemisphere 2*a*. In the center of this hemisphere 2*a* there is a cylindrical centering and drawing bolt 2*b* which has a mushroomed extremity. While the centering bolt 2*b* is made from high-grade steel, the hemisphere 2*a* as well as the remainder of the contact piece 2 and contact flange 3 is of copper. The hemispherical portion 2*a* of the contact piece 2 is seated in a conical recess 3*a*, matching this portion, of a contact flange 3. The latter forms, with additional components fixedly joined together, the movable part B of the high-current power supply. The points of contact between contact piece 2 and contact flange 3 form the contact surface 2*d*, 3*d*.

The bolt 2*b* is brought through a bore 3*b* made centrally in the flange 3. The flange 3 is furthermore provided with a closed channel 3*c* for carrying a coolant and closed by member 3*e*. A single-phase, flexible cable 4 is connected laterally to this flange 3 and leads to a load, for example a melting station not shown. The flange 3 lies with the radially outer part of its bottom on a planar supporting plate 5. The radially inner part of the bottom of flange 3 is adjoined by a sleeve 6 having a through-going axial opening, which is bolted to the flange 3. At the point of abutment between flange 3 and sleeve 6 a ring 7 is inserted as an electrical insulator. The sleeve 6 is of substantially rotationally symmetrical shape and has a constriction 6*a* of its free cross section which is adjoined by tapered sections 6*b* and 6*c* one on each side of the constriction 6*a*. In the bottom axial part of the sleeve 6 is a threaded bore 6*d* to which a pressure line, not shown, can be connected in order to blow out the interior with compressed air or nitrogen, for example.

A hydraulic cylinder 8 is flanged to the bottom of the sleeve 6 and its piston rod 8*a* projects upwardly into the interior of the sleeve 6, while the dependent cylinder 8 is covered with a cylindrical cover 9. At the bottom of this cover 9 is a limit switch 10 for limiting the piston stroke.

The upper end of the piston rod 8*a* is provided with a screw thread onto which a planar disk 11 is threaded. This disk 11 has bores 11*a*, 11*b*, to allow the compressed air or nitrogen needed for the blowout to reach the contact surfaces.

On the top of the disk 11 opposite the piston rod 8*a* there is placed a cylindrical bushing 13. An insulating disk 12 placed between the two components assures that the disk 11 and the bushing 13 are insulated electrically from one another. The axial bore 13*a* of the bushing is made to be of such diameter that the mushroom-like thickening of the centering and drawing bolt 2b can just move freely in the direction of the axis A—A. In the axially upper end of the bushing 13 a number of bores 14, 14', . . . are drilled radially, in each of which there is a ball 15, 15', . . . The diameter of the balls 15, 15', . . . is selected such that they are just freely movable in the bores 14, 14', . . . and can be completely clear of the axial bore 13a.

The operation of the apparatus is as follows:

The entire lower movable part M of the apparatus, consisting essentially of the contact flange 3, the sleeve 6, the power cable 4 and all other components affixed to these components, is at first situated below the free end of the bolt 2b on the stationary upper part of the apparatus. The piston rod 8a is in its upper end position, and the balls 15, 15', . . . are freely movable in their respective bores 14, 14', . . .

By means of a device 5a, which engages the supporting plate 5, the lower, mobile component group M is moved upwardly in the direction of the axis A—A, until the contact surface of the conical recess 3a is in form-fitting contact with the contact surface of the hemisphere 2a. Then the piston rod 8a is moved downward in axial direction A—A until the balls 15, 15', . . . run against the tapered surface 6b of the sleeve 6 and are deflected radially inwardly. Here the balls 15, 15', . . . come to rest against the likewise tapered surface 2c of the bolt 2b. As the piston rod 8a continues to descend the balls 15, 15', . . . become pinched between the inner wall of the cylindrical constriction 6a of the sleeve 6 and the tapered surface 2c of the bolt 2b, and this in turn leads to a forcible connection between the hemisphere 2a of the stationary part of the apparatus and the contact flange 3, as is shown on the right side of the drawing.

We claim:

1. A power switch used for opening and closing a high current electrical circuit, said switch comprising:

a stationary part, having a first contact shaped in the form of a hemisphere;

a movable part, having a second contact shaped in the form of a conical inside surface for mating with said first contact;

means for moving said movable part to place said second contact into form-fitting contact with said first contact; and clamp means for clamping said movable part to said stationary part, wherein said clamp means is electrically insulated from said first contact and second contact, said clamp means further comprising:

a bolt having a first end and a second end, said first end being fixedly joined to said stationary part and said second end having a mushroom like thickening; and a ball clamping device comprising a displaceable supporting member having a cylindrical interior portion and a plurality of balls outwardly seated in one position of the displaceable supporting member and comprising means for forcing said balls inwardly of said cylindrical interior portion in another position of said ball clamping device, said one position of said displaceable supporting member occurring when said movable part is positioned away from said stationary member and said another position of said displaceable supporting member occurring when said movable part engages said stationary part, and means for displacing said displaceable supporting member;

wherein said ball clamping device engages said mushroom like thickening to forcibly connect said first contact against said second contact.

2. A switch as claimed in claim 1 wherein said switch can operate with either alternating current or direct current.

3. A switch as claimed in claim 1 wherein said first and said second contacts are made of copper.

4. A switch as claimed in claim 1 wherein said bolt is made of high grade steel.

* * * * *